US005416383A

United States Patent [19]

Genz

[11] Patent Number: 5,416,383

[45] Date of Patent: May 16, 1995

[54] HIGH-PRESSURE DISCHARGE LAMP AND LOW-NOISE LAMP OPERATING SYSTEM

[75] Inventor: Andreas Genz, Berlin, Germany

[73] Assignee: Patent-Treuhand Gesellschaft Fuer Elektrische Gleuhlampen mbH, Munich, Germany

[21] Appl. No.: 240,804

[22] Filed: May 11, 1994

Related U.S. Application Data

[63] Continuation of Ser. No. 868,711, Apr. 14, 1992, abandoned.

[30] Foreign Application Priority Data

May 8, 1991 [DE] Germany ..... 4115077

[51] Int. Cl.[6] ..... H01J 61/30

[52] U.S. Cl. ..... 313/634; 313/642; 313/641

[58] Field of Search ..... 313/634, 642, 641

[56] References Cited

U.S. PATENT DOCUMENTS

| | | | |
|---|---|---|---|
| 3,590,307 | 6/1971 | Dobrusskin | 313/642 |
| 3,654,506 | 4/1972 | Kuhl et al. . | |
| 4,647,814 | 3/1987 | Dobrusskin et al. | 313/641 |
| 4,724,361 | 2/1988 | Wada et al. | 313/634 |
| 4,972,119 | 11/1990 | Kariya et al. | 313/634 |

FOREIGN PATENT DOCUMENTS

| | | | |
|---|---|---|---|
| 2574990 | 6/1986 | France . | |
| 3429105 | 2/1985 | Germany | 313/634 |
| 52-14085 | 2/1977 | Japan | 313/642 |
| 57-189449A | 11/1982 | Japan | 313/634 |
| 59-37644A | 3/1984 | Japan | 313/634 |
| 61-190845 | 8/1986 | Japan | 313/642 |
| 61-240561 | 10/1986 | Japan . | |
| 2160357 | 6/1990 | Japan | 313/642 |
| 471465 | 5/1969 | Switzerland . | |
| 2080020 | 1/1982 | United Kingdom | 313/641 |

*Primary Examiner*—Sandra L. O'Shea
*Assistant Examiner*—Matthew J. Esserman
*Attorney, Agent, or Firm*—Frishauf, Holtz, Goodman & Woodward

[57] ABSTRACT

To reduce the noise level of operation of a high-pressure metal halide discharge lamp, the lamp has a rotation-symmetrical discharge vessel (2) which has an inner surface which has a central region which is circular cylindrical and two facing transition regions (12, 13) which are straight-sided right-circular-conical and connect the central circular cylindrical region to extending shaft portions (3, 4) into which the electrodes and connecting foils are sealed. A lamp of this type, when operated from a square-wave power supply has a reduced noise level, particularly in the audio frequency range of between 6 to 20 kHz. A suitable angle between the circular cylindrical portion and the right-conical portion is between 120° and 160°, for example about 145°.

5 Claims, 2 Drawing Sheets

HIGH-PRESSURE DISCHARGE LAMP AND LOW-NOISE LAMP OPERATING SYSTEM

This application is a continuation of application Ser. No. 07/868,711, filed Apr. 14, 1992, now abandoned.

Reference to related patent and application, the disclosure of which is hereby incorporated by reference, assigned to the assignee of the present application:

U.S. Pat. No. 4,647,814, Dobrusskin et al.

U.S. Ser. No. 07/500,760, filed Mar. 28, 1990, Heider, now U.S. Pat. No. 5,138,227.

U.S. Ser. No. 07/786,503, filed Nov. 1, 1990, Bernitz, abandoned, published as German DE-OS 40 36 604 A1.

1. Field of the Invention

The present invention relates to a high-pressure discharge lamp and to a high-pressure discharge lamp-power supply connection, in which the high-pressure discharge lamp is so constructed that its operating noise level, when operated by a customary power supply, is reduced over that of prior art lamps.

2. Background

High-pressure discharge lamps, and particularly metal halide high-pressure discharge lamps of high power ratings, in the kilowatt range, and used, for example, for illumination of theater stages, motion picture or television studios or film scenes or the like, have typically been operated with electronic supply circuits in recent years. The electronic supply circuits provide square-wave current to the lamps. This permits essentially flicker-free operation of the high-pressure discharge lamp. The frequency of the square-wave supply is in the order of between 50 Hz and 1 kHz. Electronic accessory or current supply apparatus have substantial advantages over prior art ballasts, using iron core chokes or the like, due to the substantially lower weight and size of the electronic apparatus.

When operating metal-halide high-pressure discharge lamps with low-frequency square-wave supplies, it has been found that audible noise results which may, overall, exceed values of over 40 dB.

THE INVENTION

It is an object to provide an illumination system and a lamp which can provide the light expected from prior art structures with prior art accessory apparatus in which the noise emission, however, is reduced. Operating the systems with lower noise permits wider application thereof.

Briefly, the noise level of operating a high-pressure metal-halide discharge lamp can be reduced by carefully shaping the inside of the discharge vessel. In accordance with a feature of the invention, the discharge vessel is formed by two end regions which are circular-conical, with the wider or base surfaces of the cones facing each other, and being joined together by a circular cylindrical portion. The tips or peaks of the cones of the conical regions are truncated where they are merged to extending neck portions into which the current supply leads and electrodes are melt-sealed. The conical regions are formed by right circular cones, i.e. cones whose axes are at right angles to their bases.

The invention is based on the discovery that the noise apparently is caused due to resonance effects in the prior art customary cylindrical, spherical or ellipsoid-shaped inner surfaces of the discharge vessel. When operating such prior art discharge vessels with square waves, the harmonics of the square-wave current interact with the plasma in the discharge vessel, which causes the noise. Based on this discovery, various shapes of discharge vessel spaces, that is, particularly the internal configurations of discharge vessels were investigated. It has been found that noise emission can be sharply reduced when the internal shape of the discharge vessel is such that in a central region it forms essentially a circular cylinder; and in the transition regions to the respective connecting neck portions, essentially straight-walled right circular cones are formed. Optimal results were obtained when the angle at the inner wall of the circular cylindrical central region with the respective conical region is between about 120° and 160° and, preferably, between about 130° and 160°, and especially in the order of approximately 145°. If the angle becomes too high, deep dead spaces behind the electrodes will result, which reduces the "cold spot" temperature, and thus causes the color temperature of the light emitted by the lamp to rise.

The dimensions of the discharge vessel, and especially the diameter of the interior space in the circular cylindrical portion, must be so selected that the temperature, in operation of the lamp, will be appropriate for the desired light output. For example, the temperature at the inner wall of the lamp should be approximately 950° C. If the diameter is increased, the color temperature will rise. If the diameter is made smaller, the loading on the glass becomes excessive and premature devitrification may result, which, in turn, causes the high-pressure discharge lamp to fail. A suitable general average value for the length of the circular cylindrical central portion is approximately the length of the arc, or slightly higher.

DRAWINGS

FIG. 1 is a schematic side view of a metal-halide high-pressure discharge lamp showing both the outside as well as the inside wall surfaces of the transparent lamp envelope in accordance with the present invention, connected to a power supply furnishing square-wave output; and FIG. 2 is a diagram of noise emission in the audio range between about 6 and 20 kHz, and contrasting a prior art lamp (graph I) with a lamp in accordance with the present invention (graph II).

DETAILED DESCRIPTION

Figure 1:
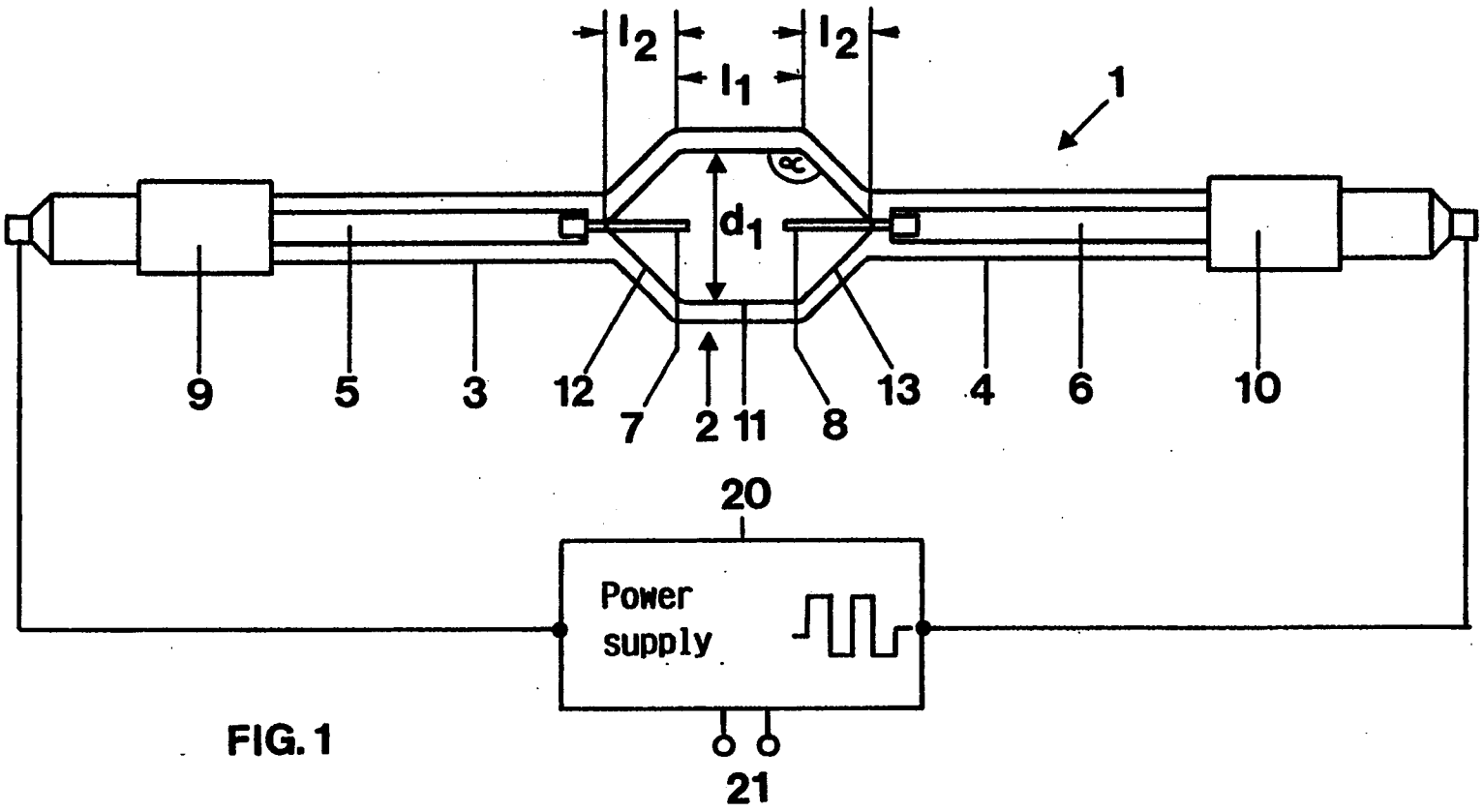

Referring first to FIG. 1:

A high-pressure discharge lamp 1 is shown, which is generally suitable for scene illumination for film or television recording. The lamp 1 has a rotation-symmetrical discharge vessel 2 made of quartz glass. The axial ends of the discharge vessel 2 have shafts or necks 3, 4 of quartz glass melt-sealed thereto. The shafts 3, 4 have molybdenum sealing foils 5, 6 melt-sealed therein. Pin electrodes or rod electrodes 7, 8, made of tungsten, are welded to the foils 5, 6 at the side of the foils facing the discharge vessel. The remote or distal ends of the foils 5, 6 are electrically connected to bases 9, 10 of the type SFa 21-12, which are fitted over the free ends of the shafts or necks 3, 4 and secured thereto by a suitable cement, as well known. The foils 5, 6 are electrically connected to electrical terminals of the bases 9, 10.

Electrical supply to the lamp is obtained from a power supply 20 which, in turn, receives energy from a suitable power network, schematically shown by terminals 21. The power supply 20 provides square-wave output energy at a frequency between about 50 to 1000 Hz, typically, for example, 100 or 120 Hz. A suitable power supply is described, e.g., in U.S. Ser. No. 07/786,503, filed Nov. 1, 1990), published as German DE-OS 40 36 604 A1.

In accordance with a feature of the invention, the interior surfaces of the discharge vessel 2 define a central circular cylindrical region 11 and two transition regions 12, 13 which are circular-conical and connect the central region 11 to the neck or shaft portions 3, 4. The central region or portion 11 has an axial length $l_1$; the transition regions 12, 13 have axial lengths $l_2$. The diameter of the central region, measured at the inside wall, is shown as $d_1$, and the angle between the region 11 and the regions 12, 13 is shown as $\alpha$.

The table, which forms part of this disclosure, provides suitable dimensions for two typical discharge vessels, one for a 2500 W metal-halide high-pressure discharge lamp and further for a 4 kW metal-halide high-pressure discharge lamp, both o f the type generally shown in FIG. 1.

| | | |
|---|---|---|
| rated lamp power | 2500 W | 4000 W |
| length $l_1$ of the cylindrical central portion 11 | 18 mm | 35.5 mm |
| axial length $l_2$ of the conical portions or regions 12, 13 | 12 mm | 15 mm |
| inner diameter $d_1$ of the central region 11 | 27 mm | 28 mm |
| angle $\alpha$ between central region 11 and conical regions 12, 13 | 145° | 145° |
| electrode spacing | 14 mm | 34 mm |
| overall length of lamp | 355 mm | 405 mm |

Figure 2:
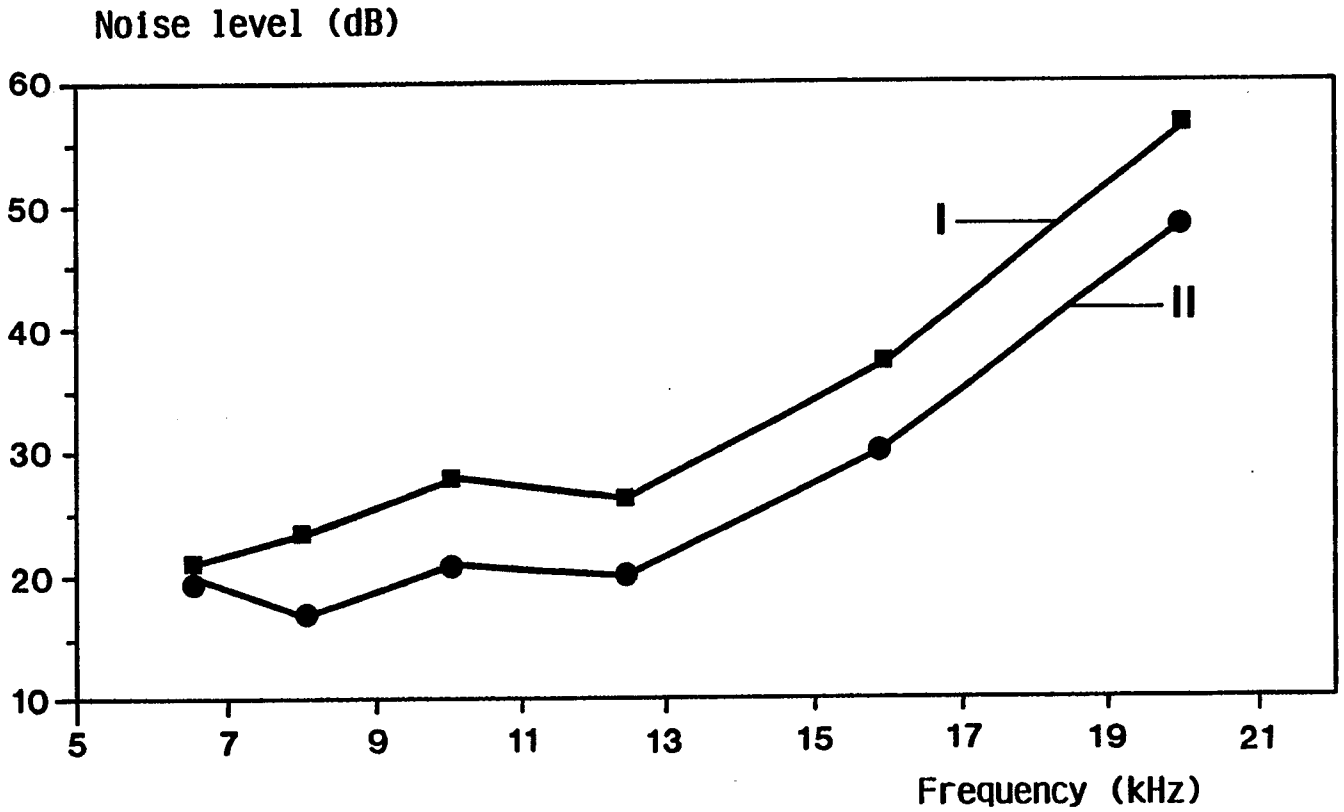

The noise level in decibels dB for noise emitted from the discharge vessel, in operation, in audible frequencies between 6 and 20 kHz of a prior art lamp and the lamp of the present invention is shown in FIG. 2. The graphs, both, show the noise level of metal-halide high-pressure discharge lamps of 2500 W. Both lamps are operated from the same power supply 20, with square-wave current at 100 kHz.

The noise level of a prior art lamp having an inner surface of the discharge vessel which is ellipsoid-shaped is shown by graph I. An otherwise identical lamp, except for the shape of the interior of the discharge vessel, and in accordance with the present invention, is shown in the graph II. As can be clearly seen, the noise emission of the lamp in accordance with the present invention in the audible range of between 8 and 20 kHz is about 6–7 dB below that of the prior art lamp.

I claim:

1. A low operating noise high-pressure discharge lamp system comprising the combination of a power supply means (20) providing essentially square-wave output power with a high-pressure discharge lamp (1) having a power rating in the kilowatt range, said lamp having a discharge vessel (2) which is rotation-symmetrical about an axis of rotation, said discharge vessel being quartz glass;

two shaft portions (3, 4) located in said axis of rotation and extending from opposite axial regions of the discharge vessel and having bases (9, 10) with terminals at the free ends thereof, said terminals being connected to said power supply means (20) for energizing the lamp;

electrodes (7, 8) and sealing foils (5, 6) connected to the electrodes, melt-sealed in said shaft portions (3, 4), said electrodes extending into the discharge vessel; and a fill of at least one metal halide, a noble gas and mercury within said discharge vessel; and said lamp being characterized in that an inner wall surface of the discharge vessel which is shaped to form a central region or portion (11) which is of circular-cylindrical shape and two connecting end portions (12, 13) connecting said circular-cylindrical central portion (11) to the shaft portions of the lamp, wherein said connecting end portions (12, 13) are of straight-sided right circular-conical shape, with the base region of the conically shaped end portions being joined to the circular-cylindrical center portion (11), and the tip or peak region of the conically shaped end portions being truncated and joined to the respective shaft portion (3, 4); and wherein the inner wall surface of the central region or portion (11) and the inner wall surfaces of said connecting end portions (12, 13) define an angle $\alpha$, and wherein said angle $\alpha$ is between about 120° and 160°.

2. A low operating noise high-pressure discharge lamp system comprising the combination of a power supply means (20) providing essentially square-wave output power with a high-pressure discharge lamp (1) having a power rating in the kilowatt range, said lamp having a discharge vessel (2) which is rotation-symmetrical about an axis of rotation, said discharge vessel being quartz glass;

two shaft portions (3, 4) located in said axis of rotation and extending from opposite axial regions of the discharge vessel and having bases (9, 10) with terminals at the free ends thereof, said terminals being connected to said power supply means (20) for energizing the lamp;

electrodes (7, 8) and sealing foils (5, 6) connected to the electrodes, melt-sealed in said shaft portions (3, 4), said electrodes extending into the discharge vessel; and a fill of at least one metal halide, a noble gas and mercury within said discharge vessel; and said lamp being characterized in that an inner wall surface of the discharge vessel which is shaped to form a central region or portion (11) which is of circular-cylindrical shape and two connecting end portions (12, 13) connecting said circular-cylindrical central portion (11) to the shaft portions of the lamp, wherein said connecting end portions (12, 13) are of straight-sided right circular-conical shape, with the base region of the conically shaped end portions being joined to the circular-cylindrical center portion (11), and the tip or peak region of the conically shaped end portions being truncated and joined to the respective shaft portion (3, 4);

wherein the inner wall surface of the central region or portion (11) and the inner wall surfaces of said connecting end portions (12, 13) define an angle $\alpha$ which is between about 130° and 155°.

3. The lamp of claim 2, wherein said angle $\alpha$ is in the order of approximately 145°.

4. The lamp of claim 2, wherein the frequency of power supply to the lamp delivered by said power supply means is between about 50 Hz to 1000 Hz.

5. The lamp of claim 2, wherein the frequency of power supply to the lamp delivered by said power supply means is between about 100 Hz to 120 Hz.

* * * * *